US009316073B2

(12) United States Patent
Fabela et al.

(10) Patent No.: US 9,316,073 B2
(45) Date of Patent: Apr. 19, 2016

(54) SLIP DEVICE FOR WELLBORE TUBULARS

(71) Applicant: Bastion Technologies, Inc., Houston, TX (US)

(72) Inventors: George Fabela, Houston, TX (US); Dewey Louvier, Houston, TX (US); Charles Don Coppedge, Houston, TX (US); Shyang Wen Tseng, Houston, TX (US)

(73) Assignee: Bastion Technologies, Inc., Houston, TX (US)

( * ) Notice: Subject to any disclaimer, the term of this patent is extended or adjusted under 35 U.S.C. 154(b) by 311 days.

(21) Appl. No.: 13/779,567

(22) Filed: Feb. 27, 2013

(65) Prior Publication Data

US 2013/0220637 A1 Aug. 29, 2013

Related U.S. Application Data

(60) Provisional application No. 61/603,689, filed on Feb. 27, 2012.

(51) Int. Cl.

| | |
|---|---|
| ***E21B 19/10*** | (2006.01) |
| ***E21B 23/00*** | (2006.01) |
| ***E21B 33/04*** | (2006.01) |

(52) U.S. Cl.

CPC ..... *E21B 23/00* (2013.01); *E21B 19/10* (2013.01); *E21B 33/0422* (2013.01)

(58) Field of Classification Search

CPC ..... E21B 19/10; E21B 23/00; E21B 33/038; E21B 33/0422; E21B 43/10

See application file for complete search history.

(56) References Cited

U.S. PATENT DOCUMENTS

| | | | | |
|---|---|---|---|---|
| 1,498,026 | A * | 6/1924 | Fuller | 188/67 |
| 1,507,325 | A * | 9/1924 | Reynolds | 464/163 |
| 1,823,183 | A * | 9/1931 | Angell | 188/67 |
| 1,883,073 | A * | 10/1932 | Stone | 188/67 |
| 4,715,625 | A | 12/1987 | Shows, Jr. et al. | |
| 6,192,981 | B1 * | 2/2001 | Boquet et al. | 166/75.13 |
| 2003/0075023 | A1 | 4/2003 | Robichaux | |
| 2005/0006147 | A1 | 1/2005 | Ayling | |
| 2006/0290043 | A1 | 12/2006 | Murata et al. | |
| 2012/0018164 | A1 | 1/2012 | Tabor et al. | |
| 2012/0048566 | A1 | 3/2012 | Coppedge et al. | |
| 2012/0279726 | A1 * | 11/2012 | Taskinen et al. | 166/382 |

OTHER PUBLICATIONS

International Search Report and Written Opinion for PCT/US2013/028084 dated May 3, 2013.

* cited by examiner

*Primary Examiner* — Frederic L Lagman
(74) *Attorney, Agent, or Firm* — Winstead PC

(57) ABSTRACT

A slip device includes a housing forming an axial bore, an upper set of slips spaced axially above a lower set of slips, and a rack and pinion actuator radially moving the upper set of slips and the lower set of slips between a retracted position and an extended position to grip a tubular disposed in the bore. The upper set of slips and the lower set of slips can be oriented to resist downward movement of the gripped tubular and to permit upward movement of the gripped tubular. One of the upper set of slips and the lower set of slips can be oriented to resist upward movement of the gripped tubular and the other of the upper set of slips and the lower set of slips can be oriented to resist downward movement of the gripped tubular.

21 Claims, 9 Drawing Sheets

SLIP DEVICE FOR WELLBORE TUBULARS

SUMMARY

According to one or more embodiments, a slip device for gripping tubulars includes a housing forming an axial bore, an upper set of slips spaced axially above a lower set of slips, and a rack and pinion actuator connected to the upper slip set and the lower slip set, the rack and pinion actuator radially moving the upper set of slips and the lower set of slips between a retracted position and an extended position to grip a tubular disposed in the bore. The upper set of slips and the lower set of slips can be oriented to resist downward movement of the gripped tubular and to permit upward movement of the gripped tubular. One of the upper set of slips and the lower set of slips can be oriented to resist upward movement of the gripped tubular and the other of the upper set of slips and the lower set of slips can be oriented to resist downward movement of the gripped tubular.

A well safety system according to one or more embodiments includes a safety slip device forming a part of a bore and comprising a housing disposing an upper set of slips spaced axially above a lower set of slips, and a rack and pinion actuator connected to the upper slip set and the lower slip set to radially move the upper and the lower set of slips between an open position permitting a tubular to move through the bore and a closed position to grip the tubular and resist downward tubular movement and permit upward tubular movement; and a bi-directional slip device forming a part of the bore and comprising a housing disposing an upper set of slips spaced axially above a lower set of slips, and a rack and pinion actuator connected to the upper slip set and the lower slip set to radially move the upper and the lower set of slips between an open position permitting the tubular to move through the bore and a closed position to grip the tubular and resist upward tubular movement and to resist downward tubular movement.

A method of safing a well according to one or more embodiments includes actuating a bi-directional slip device to grip a tubular extending through a bore of a well system, wherein the bi-directional slip device comprises a first set of slips axially spaced apart from a second set of slips, the first set of slips resisting downward movement of the gripped tubular and the second set of slips resisting upward movement of the gripped tubular; and actuating a safety slip device to grip the tubular, wherein the safety slip device comprises a first set of slips axially spaced apart from a second set of slips, wherein the first set of slips and the second set of slips resist downward movement of the gripped tubular and permit upward movement of the gripped tubular.

The foregoing has outlined some of the features and technical advantages in order that the detailed description of the slip device for wellbore tubulars that follows may be better understood. Additional features and advantages of the slip device for wellbore tubulars will be described hereinafter which form the subject of the claims of the invention. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
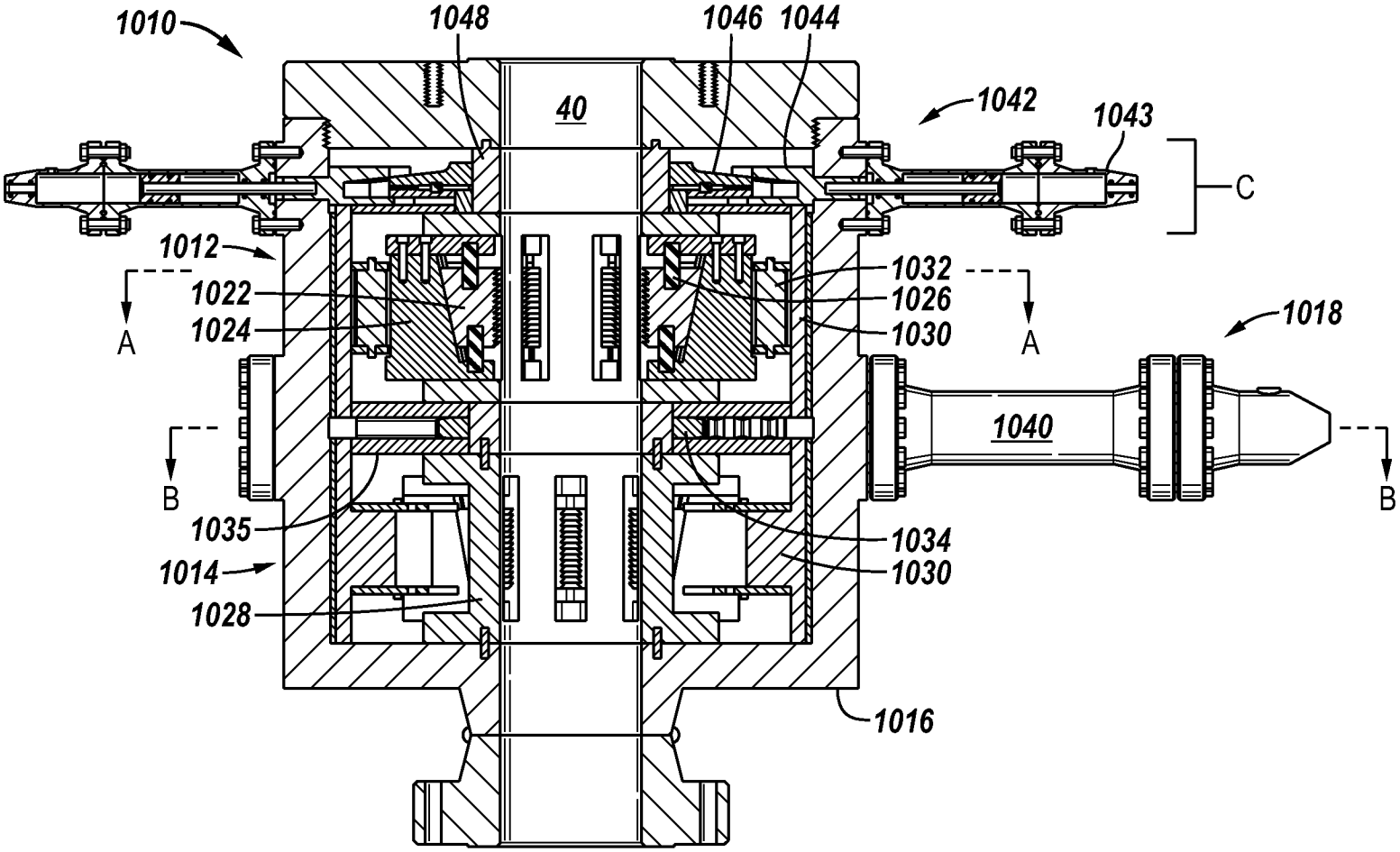
FIG. 1 illustrates a tubular gripping slip device in accordance with one or more embodiments.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth of the wellbore being the lowest point, wherein the well (e.g., wellbore, borehole) is vertical, horizontal or slanted relative to the surface.

Figure 2:
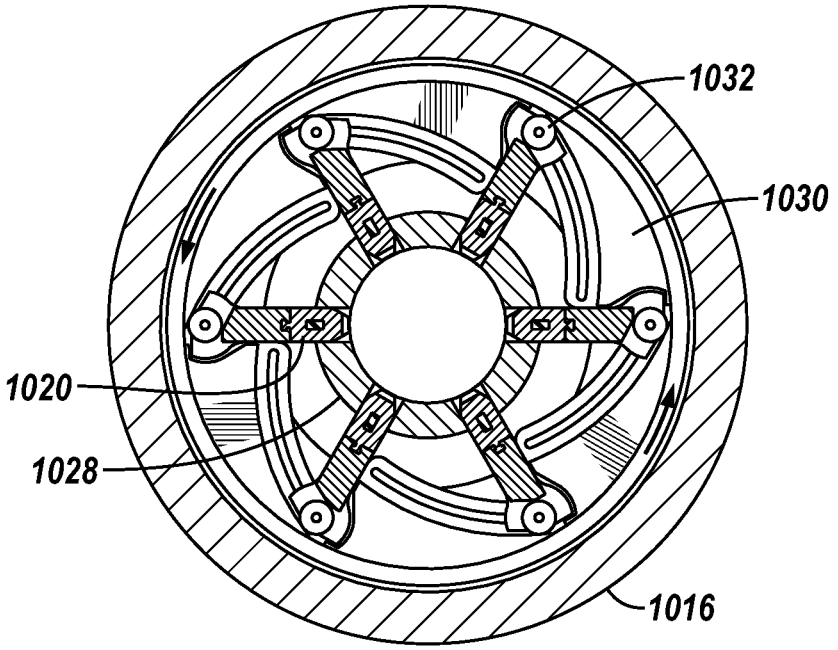
FIG. 2 is sectional view of a tubular gripping slip device along the line A-A of FIG. 1 illustrating the slips retracted in accordance with one or more embodiments.
Figure 3:
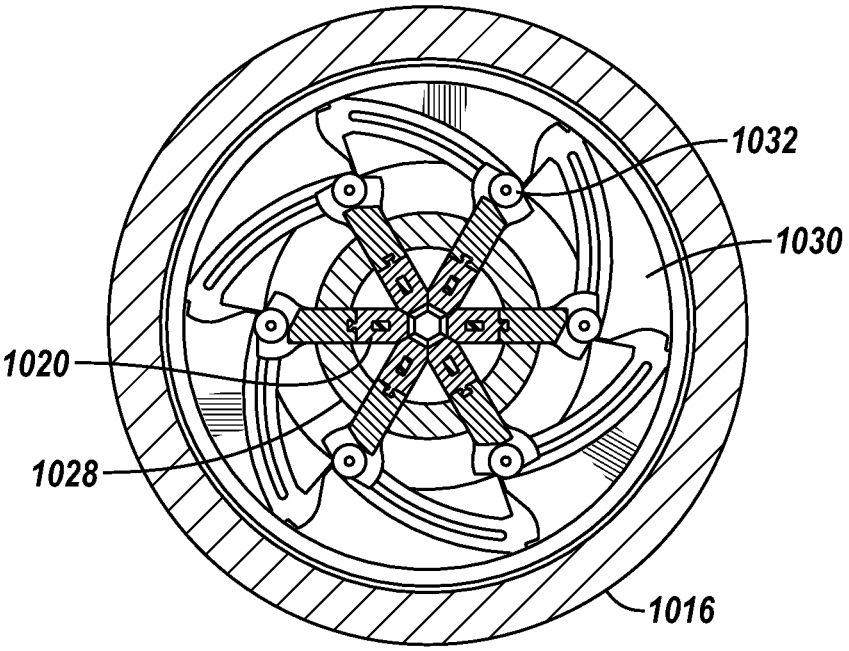
FIG. 3 is a sectional view of a tubular gripping slip device in a closed position illustrating the slips extended in accordance to one or more embodiments.

FIG. 1 illustrates an example of a tubular gripping slip device, generally denoted by the numeral 1010, in accordance with one or more embodiments. Slip device 1010 includes a first or upper slip set 1012 located vertically above a second or lower slip set 1014 relative to a bore 40 formed through a housing 1016. Upper and lower slip sets 1012, 1014 are actuated by a rack and pinion actuator 1018 between a retracted position (FIG. 2) and an extended position (FIG. 3) to grip a tubular 38 (e.g., tubular string, pipe string; see, FIGS.

8-10) that is disposed through bore 40. According to embodiments, rack and pinion actuator 1018 is hydraulically actuated.

Upper slip set 1012 and lower slip set 1014 each includes two or more individual slips 1020. In the embodiment depicted in FIG. 1, each slip set 1012, 1014 includes six slips 1020. With additional reference to FIGS. 5 and 6, each slip 1020 has a die 1022 carried on a carrier 1024. Dies 1022 have a serrated face 1021 for gripping or engaging a tubular and a sloped back wall (i.e., surface) 1023 corresponding to a sloped carrier surface 1025 of carrier 1024. Each die 1022 is moveably disposed on the respective carrier 1024 by elastomeric connectors 1026.

Figure 5:
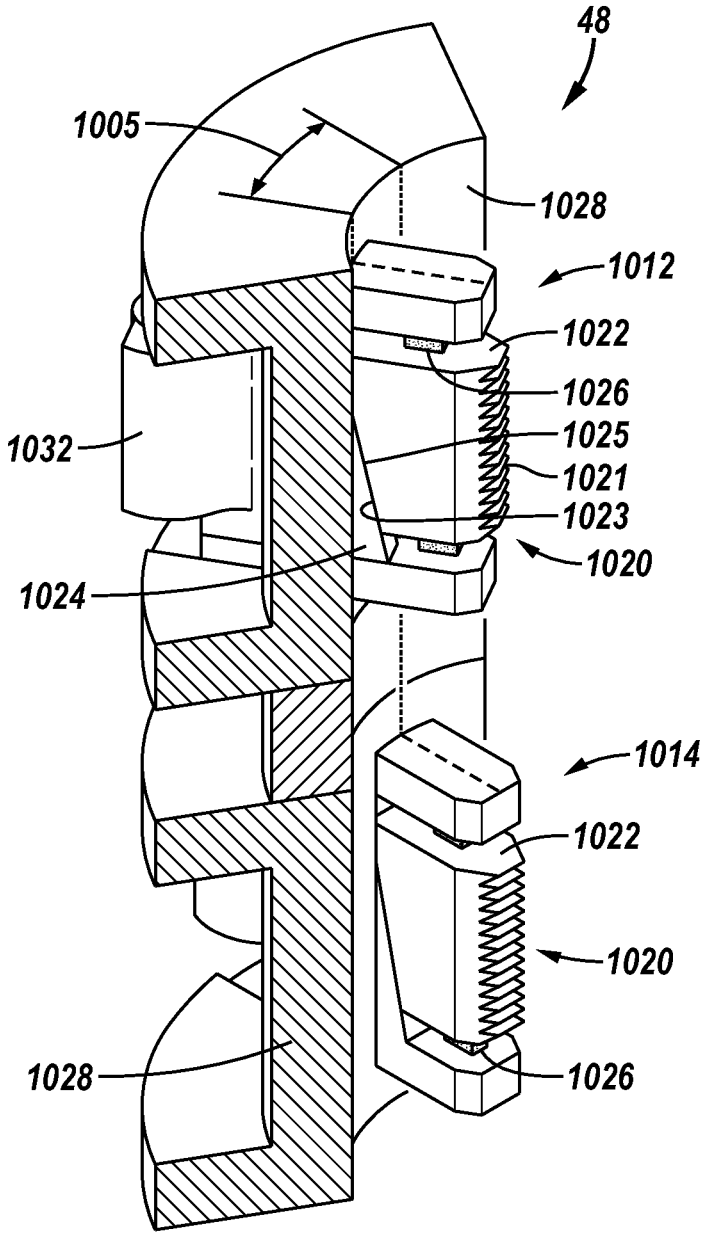
FIG. 5 illustrates an upper and a lower slip set of a tubular gripping slip device in a safety slip device configuration in accordance to one or more embodiments.

FIG. 5 illustrates upper slip set 1012 and the lower slip set 1014 arranged in a safety slip device configuration, generally denoted by the numeral 48. In this safety slip device 48 configuration, all of the slips 1020 are positioned so that the respective dies 1022 grip the tubular to resist downward movement and allow upward movement of the tubular relative to the dies.

Figure 6:
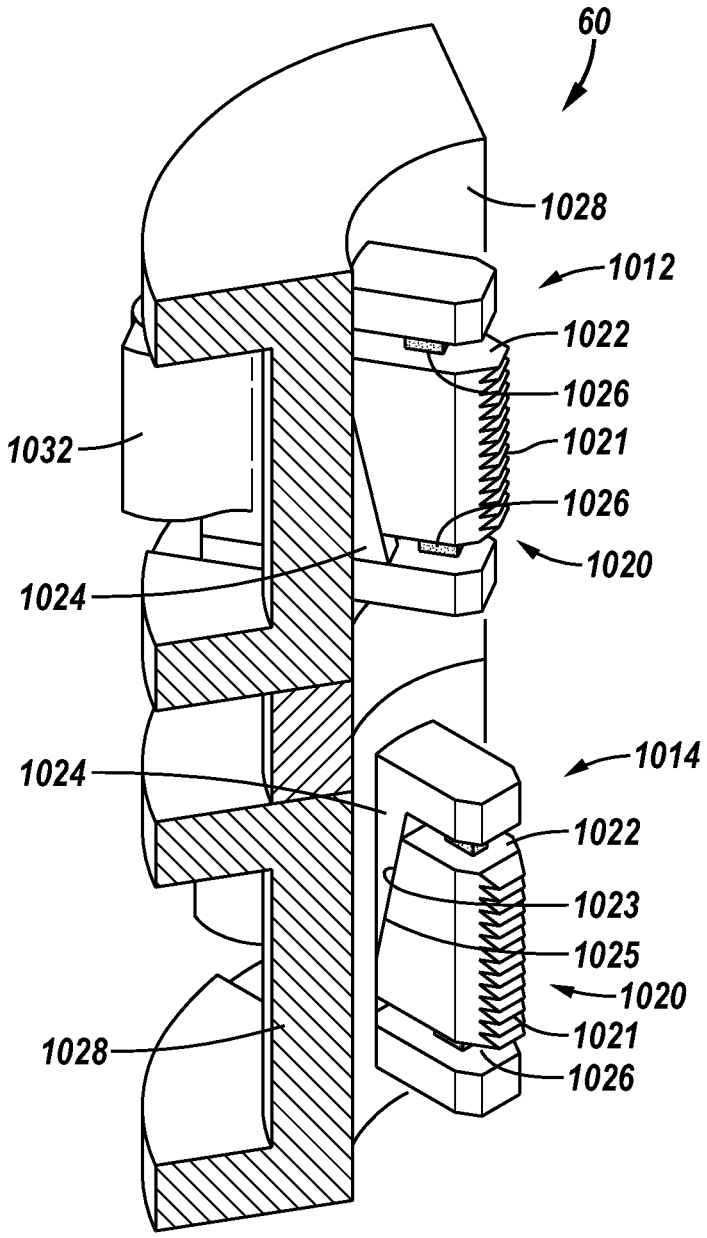
FIG. 6 illustrates an upper and a lower slip set of a tubular gripping slip device in a bi-directional slip device configuration in accordance to one or more embodiments.
Figure 7:
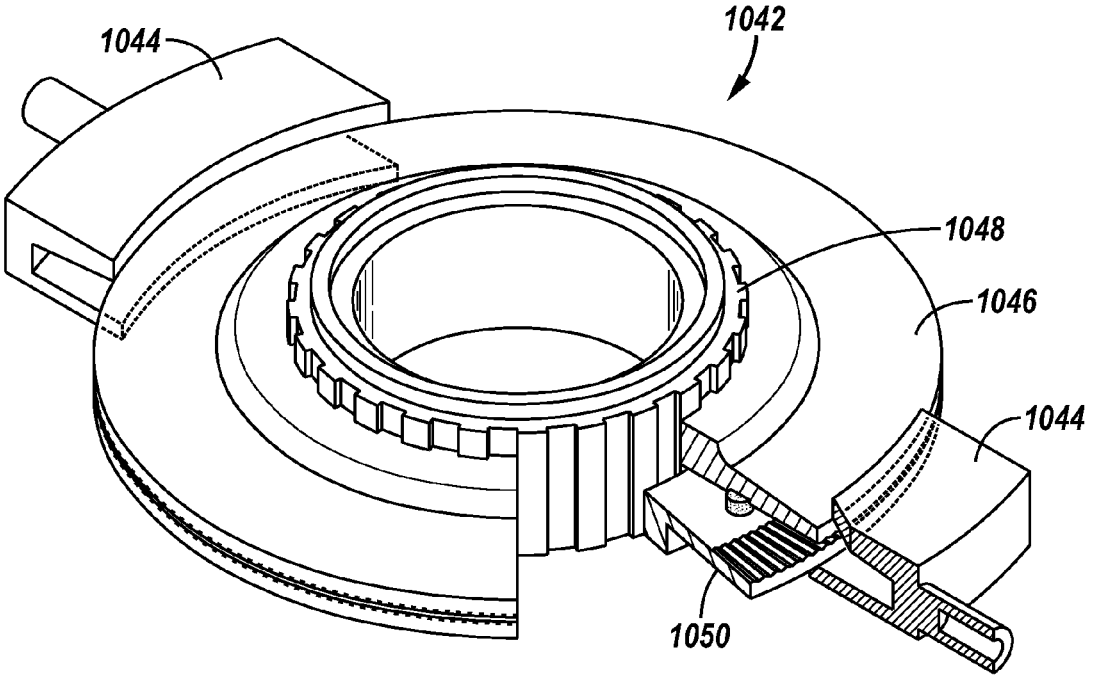
FIG. 7 illustrates a cam lock of a tubular gripping slip device in accordance to one or more embodiments.

FIG. 6 illustrates upper slip set 1012 and lower slip set 1014 in a bi-directional slip device configuration, generally denoted by the numeral 60. In the bi-directional slip device 60 configuration slips 1020 of upper slip set 1012 are positioned so that dies 1022 grip the tubular and resist downward vertical movement and the slips 1020 of lower slip set 1014 are inverted such that slips 1020 of lower slip set 1014 are positioned to grip the tubular to resist upward tubular movement and allow downward tubular movement.

According to one or more embodiments, upper slips 1020 and lower slips 1020 are angular offset from one another by an offset angle identified by the numeral 1005 in FIG. 5. Offset angle 1005 is depicted in FIGS. 1 and 5 to be approximately 30 degrees although other offset angles 1005 may be utilized. Utilization of axially spaced apart slip sets 1012, 1014 having radially offset slips 1020 serve to center tubular 38 in bore 40 and mitigate the trapping of the tubular between adjacent individual slips 1020 of a slip set.

A guide sleeve or housing 1028 is positioned in housing 1016 and defines bore 40 axially therethrough. Guide sleeve 1028 may be formed in one or more sections. Slips 1020 extend through guide sleeve 1028. Guide sleeve 1028 and upper and lower slip sets 1012, 1014 are disposed inside of a rotational cam generally denoted by the numeral 1030. Each slip 1020 is connected to cam 1030 by a cam follower 1032. In the embodiment depicted in FIG. 1, slips 1020 of upper slip set 1012 are connected to an upper cam 1030 and lower slip set 1014 is connected to a lower cam 1030. According to one or more embodiments, cams 1030 are disposed inside of cam bearing liners that can distribute concentrated loads from cam followers 1032 to the housing.

Figure 4:
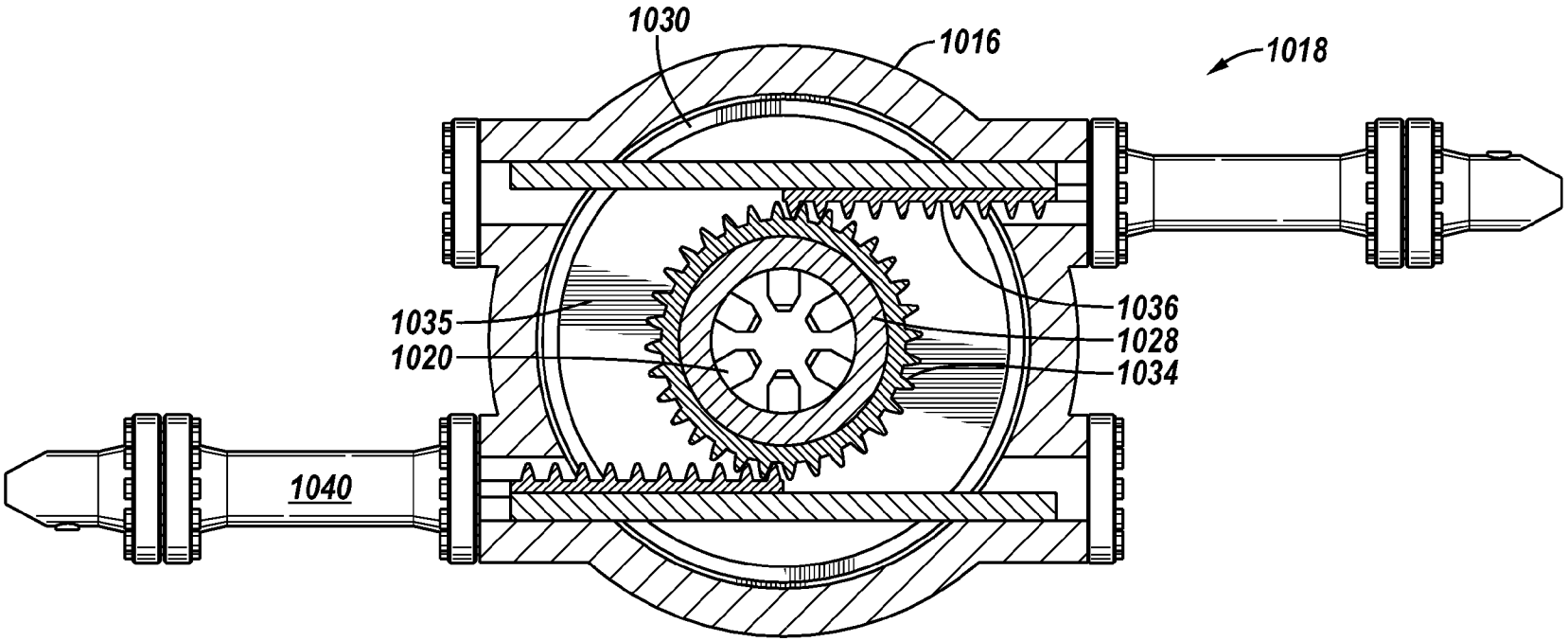
FIG. 4 illustrates a tubular gripping slip device along the line B-B of FIG. 1 in accordance to one or more embodiments.

With reference in particular to FIGS. 1 and 4, rack and pinion actuator 1018 includes a pinion gear 1034 connected to cam 1030 to rotate with cam 1030. Pinion gear 1034 is connected to the respective upper and lower cams 1030 by spacers 1035 in the FIG. 1 depiction. Rack gear 1036 is connected to pinion gear 1034 and linearly moved by actuator 1040, for example a hydraulic actuator.

According to one or more embodiments, slip device 1010 includes a cam brake 1042. A non-limiting example of a cam brake 1042 is now described with reference in particular to FIG. 1 and section C-C illustrated in FIG. 3. In this example, cam brake 1042 includes a shoe 1044 linearly operated by an actuator, e.g., hydraulic actuator, 1043. A first lock rotor 1046 is connected (i.e., splined) to a spline sleeve 1048 of guide sleeve 1028 such that first lock rotor 1046 is fixed in torsion and moves vertically. A second lock rotor 1050 is connected with cam 1030 so as to rotate with cam 1030. A spring 1052, e.g., elastomer, is positioned between first and second rotors 1046, 1050 to urge the rotors a part and bias shoe 1044 to disengage from rotors 1046, 1050. Actuator 1043 is operated to move shoe 1044 into engagement with rotors 1046, 1050 thereby locking rotor 1050 and cams 1030 with rotational stationary rotor 1046 and guide sleeve 1028 via spline sleeve 1048. In the locked position, upper and lower slips sets 1012, 1014 are maintained in rotationally stationary position. As described above, first lock rotor 1046 is splined to spline sleeve 1048 in a manner such that lock rotor 1046 is vertically moveable along spline sleeve 1048 and cams 1030 is may float and/or pivot relative to the clam bearing liner positioned between the cams 1030 and housing 1016. When cam brake 1042 is in the locked position engaging rotors 1046, 1050 together, the splined connection of rotor 1046 and spline sleeve 1048 may permit cams 1030 to float while slips 1020 remain in gripping engagement with the tubular.

Figure 8:
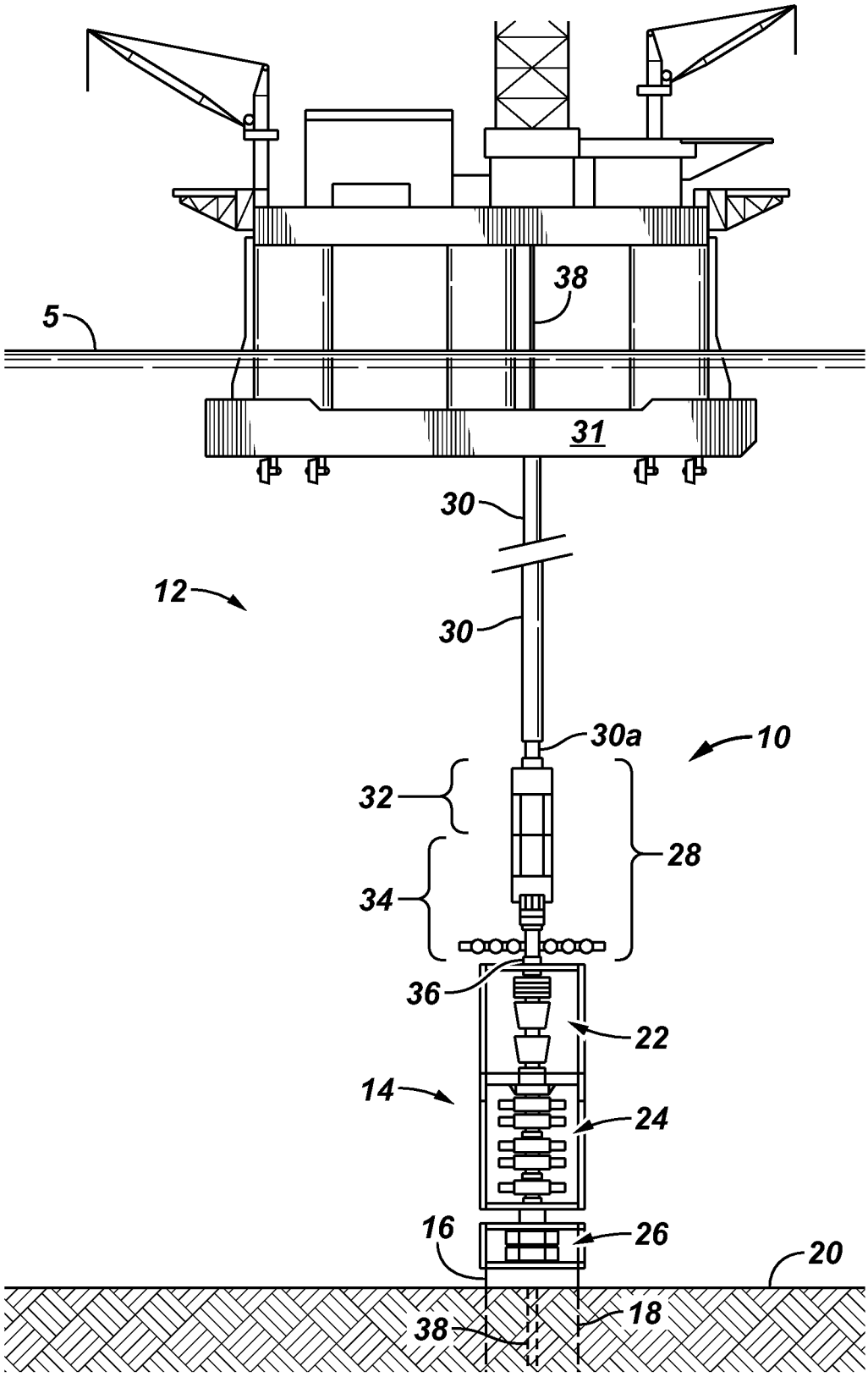
FIGS. 8 and 9 illustrate a subsea well system incorporating tubular gripping slip devices in accordance with one or more embodiments.

FIG. 8 is a schematic illustration of a subsea well safety system, generally denoted by the numeral 10, being utilized in a subsea well drilling system 12. In the depicted embodiment drilling system 12 includes a BOP stack 14 which is landed on a subsea wellhead 16 of a well 18 (i.e., wellbore) penetrating seafloor 20. BOP stack 14 conventionally includes a lower marine riser package ("LMRP") 22 and blowout preventers ("BOP") 24. The depicted BOP stack 14 also includes subsea test valves ("SSTV") 26.

Figure 9:
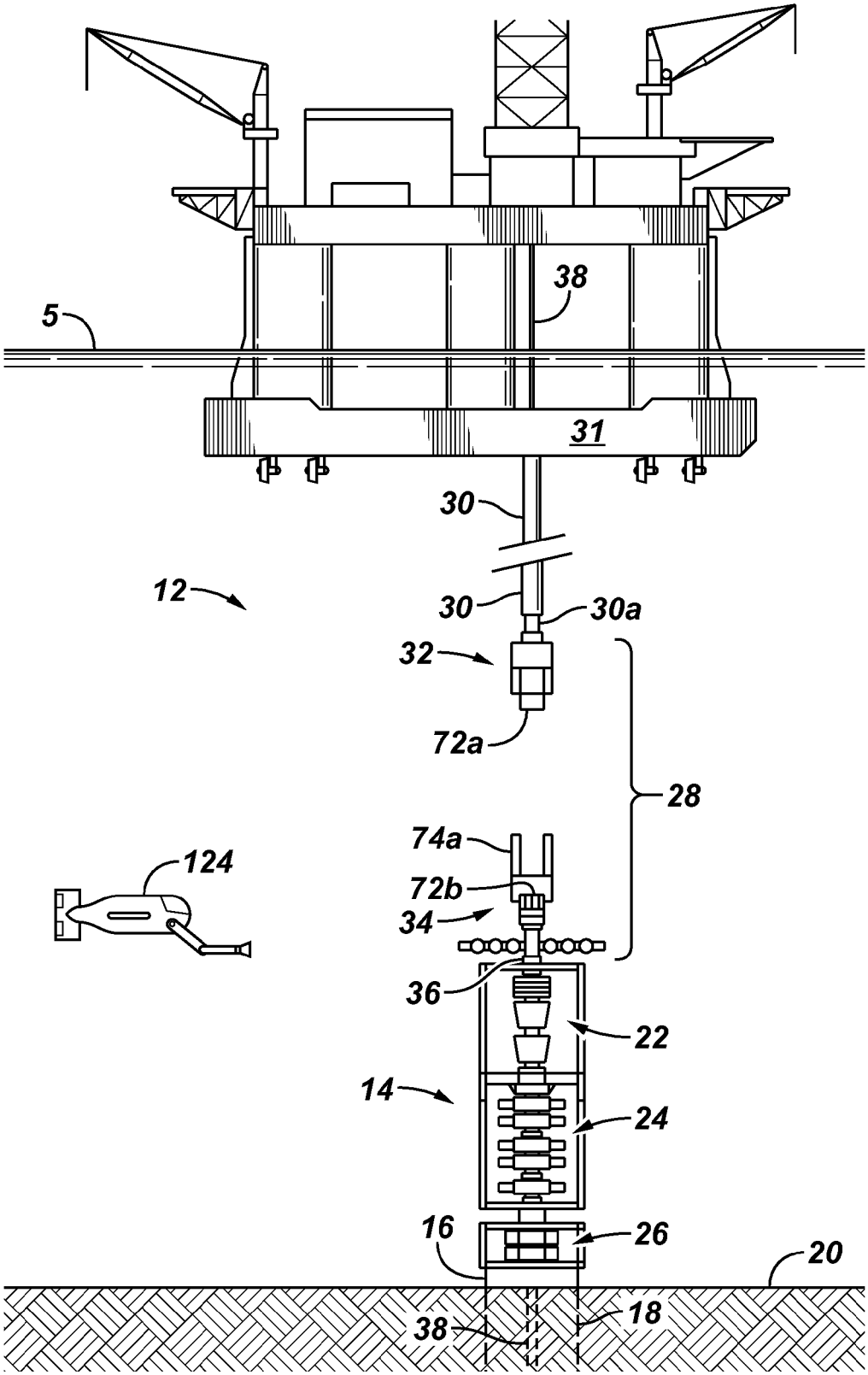

Subsea well safety system 10 includes safing package, or assembly, referred to herein as a catastrophic safing package ("CSP") 28 that is landed on BOP stack 14 and operationally connects a riser 30 extending from platform 31 (e.g., vessel, rig, ship, etc.) to BOP stack 14 and thus well 18. CSP 28 includes an upper CSP 32 and a lower CSP 34 that are adapted to separate from one another in response to initiation of a safing sequence thereby disconnecting riser 30 from the BOP stack 14 and well 18, for example as illustrated in FIG. 9. The safing sequence is initiated in response to parameters indicating the occurrence of a failure in well 18 with the potential of leading to a blowout of the well.

Wellhead 16 is a termination of the wellbore at the seafloor and generally has the necessary components (e.g., connectors, locks, etc.) to connect components such as BOPs 24, valves (e.g., test valves, production trees, etc.) to the wellbore. The wellhead also incorporates the necessary components for hanging casing, production tubing, and subsurface flow-control and production devices in the wellbore.

LMRP 22 and BOP stack 24 are coupled together by a wellbore connector that is engaged with a corresponding mandrel on the upper end of BOP stack 14. LMRP 22 typically provides the interface (i.e., connection) of the BOPs 24 and the bottom end 30*a* of marine riser 30 via a riser connector 36 (i.e., riser adapter). Riser connector 36 commonly includes a riser adapter for connecting the lowest end 30*a* of riser 30 (e.g., bolts, welding, hydraulic connector) and a flex joint that provides for a range of angular movement of riser 30 (e.g., 10 degrees) relative to BOP stack 14, for example to compensate for vessel 31 offset and current effects along the length of riser 30. Riser connector 36 may further include one or more ports for connecting fluid (i.e., hydraulic) and electrical conductors, i.e., communication umbilical, which may extend along (exterior or interior) riser 30 from the drilling platform located at surface 5 to subsea drilling system 12. For example, it is common for a hydraulic choke line 44 and a hydraulic kill line 46 to extend from the surface for connection to BOP stack 14.

Riser 30 is a tubular string that extends from the drilling platform 31 down to well 18. The riser is in effect an extension of the wellbore extending through the water column to drilling vessel 31. The riser diameter is large enough to allow for drillpipe, casing strings, logging tools and the like to pass through. For example, in FIGS. 8 and 9, a tubular 38 (e.g., drillpipe, pipe string) is illustrated deployed from drilling platform 31 into riser 30. Drilling mud and drill cuttings can be returned to surface 5 through riser 30. Communication umbilical (e.g., hydraulic, electric, optic, etc.) can be deployed exterior to or through riser 30 to CSP 28 and BOP stack 14. A remote operated vehicle ("ROV") 124 is depicted in FIG. 9 and may be utilized for various tasks.

Figure 10:
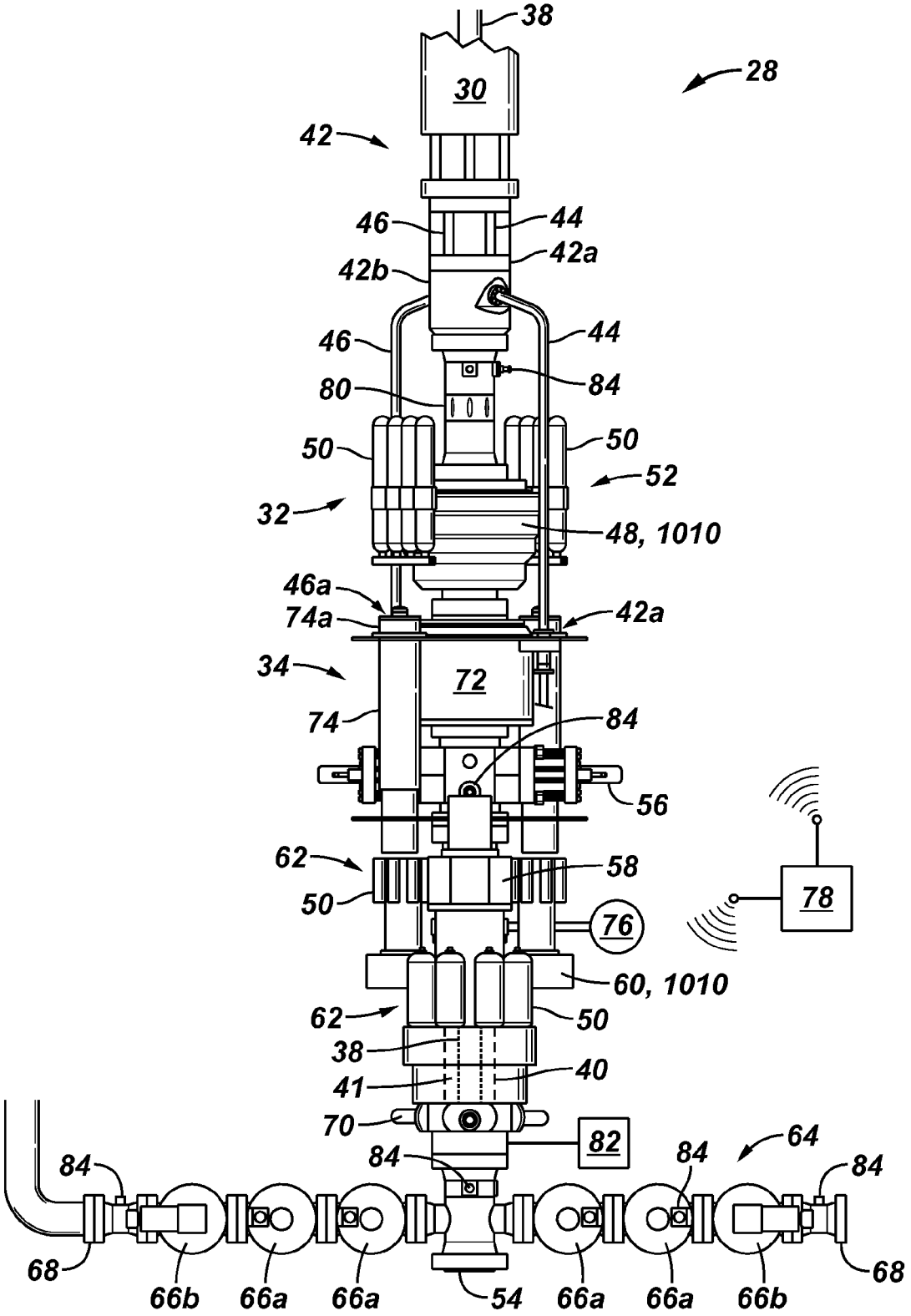
FIG. 10 illustrates a subsea well safety system incorporating tubular gripping slip devices in accordance to one or more embodiments.

Refer now to FIG. 10 which illustrates a subsea well safing package 28 according to one or more embodiments. CSP 28 depicted in FIG. 10 is further described with reference to FIGS. 8 and 9. In the depicted embodiment, CSP 28 includes upper CSP 32 and lower CSP 34. Upper CSP 32 includes a riser connector 42 which may include a riser flange connection 42*a*, and a riser adapter 42*b* which may provide for connection of communication umbilicals and extension of the communication umbilicals to various CSP 28 devices and/or BOP stack 14 devices. For example, a choke line 44 and a kill line 46 are depicted extending from the surface with riser 30 and extending through riser adapter 42*b* for connection to the choke and kill lines of BOP stack 14. CSP 28 includes a choke stab 44*a* and a kill line stab 46*a* for interconnecting the upper portion of choke line 44 and kill line 46 with the lower portion of choke line 44 and kill line 46.

An internal longitudinal bore 40, depicted in FIG. 10 by the dashed line through lower CSP 34, is formed through riser 30 and the interconnected well system devices (e.g., CSP 28, BOP stack 14) for passing tubular 38 into the well. An annulus 41 is formed between the outside diameter of tubular 38 and the diameter of bore 40.

Upper CSP 32 further includes a slip device 1010 adapted to close on tubular 38. In this embodiment, slip device 1010 is arranged in a safety slip device 48 configuration (see, FIG. 5). Slip device 1010 is actuated in the depicted embodiment by hydraulic pressure from an accumulator 50 located for example in an upper accumulator pod 52. In the safety slip device 48 configuration, slip device 1010 grips tubular 38 and resists downward vertical movement when the slips are extended.

Lower CSP 34 includes a connector 54 to connect to BOP stack 14, for example, via riser connector 36, rams 56 (e.g., blind rams), tubular shears 58, lower slip device 1010, and a vent system 64 (e.g., valve manifold) having one or more valves 66 (e.g., vent valves 66*a*, choke valves 66*b*, connection mandrels 68). In this embodiment, lower slip device 1010 is arranged in a bi-directional slip device 60 configuration (see, FIG. 6) whereby when the slip device is in the extended position one of the slip sets 1012, 1014 engages tubular 38 and resists downward tubular movement and the other of the slip sets 1012, 1014 resists upward tubular movement.

In the depicted embodiment, lower CSP 34 further includes a deflector device 70 (e.g., impingement device, shutter ram) disposed above vent system 64 and below lower slip device 1010, tubular shear 58, and blind ram 56. Lower CSP 34 includes a plurality of hydraulic accumulators 50 that are arranged and connected in one or more lower hydraulic pods 62 for operation of various devices (e.g., lower slip device 1010) of CSP 28. As will be further described below, CSP 28, in particular lower CSP 34, may include methanol, or other chemical, source 76 operationally connected for injecting into lower CSP 34, for example to prevent hydrate formation.

Upper CSP 32 and lower CSP 34 are detachably connected to one another by a connector 72. CSP connector 72 is depicted in the illustrated embodiments as a collet connector, comprising a first connector portion 72*a* and a second mandrel connector portion 72*b*. An ejector device 74 (e.g., ejector bollards) are operationally connected between upper CSP 32 and lower CSP 34 to separate upper CSP 32 and riser 30 from lower CSP 34 and BOP stack 14 after connector 72 has been actuated to the unlocked position. CSP 28 also includes a plurality of sensors 84 which can sense various parameters, such as and without limitation, temperature, pressure, strain (tensile, compression, torque), vibration, and fluid flow rate.

CSP 28 includes a control system 78 which may be located subsea, for example at CSP 28 or at a remote location such as at the surface. Control system 78 may include one or more controllers which are located at different locations. For example, in at least one embodiment, control system 78 includes an upper controller 80 (e.g., upper command and control data bus) and a lower controller 82 (e.g., lower command and controller bus). Control system 78 may be connected via conductors (e.g., wire, cable, optic fibers, hydraulic lines) and/or wirelessly (e.g., acoustic transmission) to various subsea devices (e.g., slip devices 1010, shear 58) and to surface (i.e., drilling platform 31) control systems.

In case of an emergency, safety system 10 may be actuated to shut-in well 18. Upon activation, lower slip device 1010 (i.e., bi-directional slip device 60) is operated to the extended or closed position (e.g., FIG. 3) such that slips 1020 grip tubular 38. With reference to FIG. 6, slips 1020 of upper slip set 1012 resist downward tubular movement and lower slip set 1014 resist upward tubular movement. Tubular 38 is then secured in upper CSP 34 by closing upper slip device 1010 (i.e., safety slip device 48). As described with reference in particular to FIGS. 1, 3, and 5, in this example upper and lower slip sets 1012, 1014 resist downward tubular movement and allow upward tubular movement.

With tubular 38 secured by upper slip device 1010 and lower slip device 1010, tubular shear 58 is activated to shear tubular 38. Lower slip device 1010 in the bi-directional slip device 60 configuration resists ejection of tubular 38 from well 18 and also resists downward movement of tubular 38 into well 18. Upper slip device 1010 in the safety slip device 48 configuration allows tubular 38 to move upward while being severed by tubular shear 58.

In accordance with some systems, such as the depicted safety system 10, upper CSP 32 and lower CSP 34 are disconnected from one another by operating CSP connector 72 to a disconnected position. Riser 30 and upper CSP 32 can be separated (e.g., ejected) from lower CSP 34 and BOP stack 14 by activating ejector device 74 (i.e., ejector bollards), see, e.g., FIGS. 8-10.

Rack and pinion actuator 1018 provides for an extended range of movement of slips 1020 such that a large range of tubular 38 diameters may be gripped by slips 1020. It is further noted that in some embodiments, for example as upper slip device 1010 and lower slip device 1010 are utilized in a well safety system, that a failsafe gripping force may be applied to tubular 38. For example, upon the occurrence of a well failure, tubular slip device 1010 may apply a radial force to tubular 38 that crushes tubular 38 yet maintains a grip to minimize the chance of the tubular falling into the wellbore and/or being ejected from the wellbore. According to at least one embodiment, slip device 1010 is adapted to support a tubular load of 2,000,000 pounds.

A well safety system 12 according to one or more embodiments includes a safety slip device 1010 forming a part of a bore 40 and comprising a housing disposing an upper set of slips 1012 spaced axially above a lower set of slips 1014, and a rack and pinion actuator connected to the upper slip set and the lower slip set to radially move the upper and the lower set of slips between an open position permitting a tubular 38 to move through the bore and a closed position to grip the tubular and resist downward tubular movement and permit upward tubular movement; and a bi-directional slip device 1010 forming a part of the bore and comprising a housing disposing an upper set of slips spaced axially above a lower set of slips, and a rack and pinion actuator connected to the upper slip set and the lower slip set to radially move the upper and the lower set of slips between an open position permitting the tubular to move through the bore and a closed position to grip the tubular and resist upward tubular movement and to resist downward tubular movement.

A method of safing well 18 according to one or more embodiments includes actuating a bi-directional slip device to grip a tubular extending through a bore of a well system, wherein the bi-directional slip device comprises a first set of slips axially spaced apart from a second set of slips, the first set of slips resisting downward movement of the gripped tubular and the second set of slips resisting upward movement of the gripped tubular; and actuating a safety slip device to grip the tubular, wherein the safety slip device comprises a first set of slips axially spaced apart from a second set of slips, wherein the first set of slips and the second set of slips resist downward movement of the gripped tubular and permit upward movement of the gripped tubular.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A slip device for gripping tubulars, the device comprising:

a housing forming an axial bore;

an upper set of slips spaced axially above a lower set of slips; and a rack and pinion actuator connected to the upper set of slips and the lower set of slips, the rack and pinion actuator radially moving in unison the upper set of slips and the lower set of slips between a retracted position removed from the bore and an extended position to grip and secure a tubular disposed in the bore, wherein the upper and the lower slip sets are simultaneously in the retracted or extended position.

2. The device of claim 1, wherein the upper set of slips and the lower set of slips are angularly offset from one another.

3. The device of claim 1, wherein the upper set of slips comprises six upper slips and the lower set of slips comprises six lower slips.

4. The device of claim 1, wherein:

the upper set of slips comprises six upper slips and the lower set of slips comprises six lower slips; and the upper slips and the lower slips are angularly offset from one another.

5. The device of claim 1, wherein in a safety configuration the upper set of slips and the lower set of slips are oriented to resist downward movement of the gripped tubular and to permit upward movement of the gripped tubular.

6. The device of claim 1, wherein in a bi-directional configuration one of the upper set of slips and the lower set of slips is oriented to resist upward movement of the gripped tubular and to permit downward movement the gripped tubular and the other of the upper set of slips and the lower set of slips is oriented to resist downward movement of the gripped tubular and to permit upward movement of the gripped tubular.

7. The device of claim 1, comprising:

a cam disposed in the housing and rotationally connected to the rack and pinion actuator; and a guide sleeve forming the bore through the housing, wherein the upper set of slips and the lower set of slips are connected to the cam and extend through the guide sleeve.

8. The device of claim 7, comprising a cam brake actuatable to lock the cam and the guide sleeve together.

9. The device of claim 1, wherein the lower set of slips is oriented to resist upward movement of the gripped tubular and to permit downward movement of the gripped tubular and the upper set of slips is oriented to resist downward movement of the gripped tubular and to permit upward movement of the gripped tubular.

10. The device of claim 1, wherein the upper set of slips and the lower set of slips are angularly offset from one another, and further comprising:

a cam disposed in the housing and rotationally connected to the rack and pinion actuator; and a guide sleeve forming the bore through the housing, wherein the upper set of slips and the lower set of slips are connected to the cam and extend through the guide sleeve.

11. A well safety system, comprising:

a safety slip device forming a part of a bore and comprising a housing disposing an upper set of slips spaced axially above a lower set of slips, and a rack and pinion actuator connected to the upper set of slips and the lower set of slips to radially move the upper and the lower sets of slips in unison between an open position permitting a tubular to move through the bore and a closed position to grip the tubular and resist downward tubular movement and permit upward tubular movement; and a bi-directional slip device forming a part of the bore and comprising a housing disposing an upper set of slips spaced axially above a lower set of slips, and a rack and pinion actuator connected to the upper set of slips and the lower set of slips to radially move the upper and the lower sets of slips in unison between an open position permitting a tubular to move through the bore and a closed position to grip the tubular and resist upward tubular movement and to resist downward tubular movement, wherein the upper and the lower slip sets are simultaneously in the retracted or extended position.

12. The system of claim 11, further comprising a tubular shear connected in the system between the safety slip device and the bi-directional slip device.

13. The system of claim 11, wherein the upper set of slips of the bi-directional slip device are oriented to resist downward movement of the gripped tubular and to permit upper movement of the gripped tubular and the lower set of slips of the bi-directional slip device are oriented to resist upward movement of the gripped tubular and to permit downward movement of the gripped tubular.

14. The system of claim 11, wherein:

the safety slip device comprises:

a cam disposed in the housing and rotationally connected to the rack and pinion actuator; and a guide sleeve forming the bore through the housing, wherein the upper set of slips and the lower set of slips are connected to the cam and extend through the guide sleeve; and the bi-directional slip device comprises:

a cam disposed in the housing and rotationally connected to the rack and pinion actuator; and a guide sleeve forming the bore through the housing, wherein the upper set of slips and the lower set of slips are connected to the cam and extend through the guide sleeve.

15. The system of claim 11, wherein:

the safety slip device comprises:

a cam disposed in the housing and rotationally connected to the rack and pinion actuator;

a guide sleeve forming the bore through the housing, wherein the upper set of slips and the lower set of slips are connected to the cam and extend through the guide sleeve; and a cam brake actuatable to lock the cam and the guide sleeve together; and the bi-directional slip device comprises:

a cam disposed in the housing and rotationally connected to the rack and pinion actuator;

a guide sleeve forming the bore through the housing, wherein the upper set of slips and the lower set of slips are connected to the cam and extend through the guide sleeve; and a cam brake actuatable to lock the cam and the guide sleeve together.

16. The system of claim 15, wherein the upper set of slips of the bi-directional slip device are oriented to resist downward movement of the gripped tubular and to permit upper movement of the gripped tubular and the lower set of slips of the bi-directional slip device are oriented to resist upward movement of the gripped tubular and to permit downward movement of the gripped tubular.

17. A method of safing well, comprising:

actuating a bi-directional slip device to grip a tubular extending through a bore of a well system, wherein the bi-directional slip device comprises a first set of slips axially spaced vertically apart from a second set of slips, the first set of slips resisting downward movement of the gripped tubular and permitting upward movement of the gripped tubular and the second set of slips resisting upward movement of the gripped tubular and permitting downward movement of the gripped tubular, wherein the actuating comprises radially moving in unison the first and the second sets of slips from an open position removed from the bore to an extend position gripping the tubular; and actuating a safety slip device to grip the tubular, wherein the safety slip device comprises an upper set of slips axially spaced above a lower set of slips, wherein the upper set of slips and the upper set of slips resist downward movement of the gripped tubular and permit upward movement of the gripped tubular, wherein the actuating comprises radially moving in unison the upper and the lower sets of slips from an open position removed from the bore to an extend position gripping the tubular.

18. The method of claim 17, further comprising shearing the tubular between the safety slip device and the bi-directional slip device while the tubular is gripped by the safety slip device and by the bi-directional slip device.

19. The method of claim 17, wherein:

the actuating the bi-directional slip device comprises actuating a bi-directional rack and pinion actuator; and the actuating the safety slip device comprises actuating a safety rack and pinion actuator.

20. The method of claim 19, further comprising shearing the tubular between the safety slip device and the bi-directional slip device while the tubular is gripped by the safety slip device and by the bi-directional slip device.

21. The method of claim 17, wherein the second set of slips of the bi-directional slip device is positioned below the first set of slips.

* * * * *